US007791493B2

(12) United States Patent
Ikeura

(10) Patent No.: US 7,791,493 B2
(45) Date of Patent: Sep. 7, 2010

(54) APPARATUS FOR DETERMINING FAILURE OF VEHICLE ANTENNA

(75) Inventor: Masashi Ikeura, Osaka (JP)

(73) Assignee: Panasonic Corporation, Osaka (JP)

( * ) Notice: Subject to any disclaimer, the term of this patent is extended or adjusted under 35 U.S.C. 154(b) by 293 days.

(21) Appl. No.: 12/031,240

(22) Filed: Feb. 14, 2008

(65) Prior Publication Data

US 2008/0204332 A1 Aug. 28, 2008

(30) Foreign Application Priority Data

Feb. 28, 2007 (JP) ..... 2007-048741

(51) Int. Cl.
*G08B 21/00* (2006.01)

(52) U.S. Cl. ..... 340/635; 361/72

(58) Field of Classification Search ..... 340/635, 340/653; 361/15, 17, 92; 343/703, 711
See application file for complete search history.

(56) References Cited

U.S. PATENT DOCUMENTS 4,322,766 A * 3/1982 Becker et al. ..... 340/635
5,345,225 A * 9/1994 Davis ..... 340/635
5,506,572 A * 4/1996 Hills et al. ..... 340/635
6,570,505 B1 * 5/2003 Malenfant ..... 361/92
2004/0164913 A1 * 8/2004 Ogino ..... 343/711

FOREIGN PATENT DOCUMENTS

JP 62-010704 1/1987

* cited by examiner

*Primary Examiner*—John A Tweel, Jr.
(74) *Attorney, Agent, or Firm*—RatnerPrestia

(57) ABSTRACT

An on-vehicle device has a receiving antenna for receiving a radio signal from a mobile device, a receiving circuit for returning an electric signal obtained by conversion by the receiving antenna to the original state, a control unit for determining whether a received signal from the receiving circuit is correct or incorrect, a driving circuit that is driven in response to a driving signal from the control unit and supplies antenna current to a vehicle antenna, and a detector for detecting whether the vehicle antenna operates normally. A detection signal of the detector is fed back to the control unit through the receiving circuit, and the failure determination of the vehicle antenna is performed.

4 Claims, 3 Drawing Sheets

APPARATUS FOR DETERMINING FAILURE OF VEHICLE ANTENNA

BACKGROUND OF THE INVENTION

1. Field of the Invention

The present invention relates to an on-vehicle device mounted on a vehicle and used for a smart entry system or keyless entry system (hereinafter referred to as "system") that communicates with a mobile device and remotely controls the locking/unlocking of a vehicle door or the like or the start of the engine, and more particularly to an on-vehicle device for determining a failure of a vehicle antenna.

2. Background Art

Recently, the system for locking or unlocking a vehicle door or starting an engine by remote control without using a machine key has become widespread in the field of the development of a vehicle such as an automobile. The system allows a user to automatically open or close the door lock of a vehicle by operating a desired push button of a mobile device, and allows an on-vehicle device mounted on the vehicle to detect the existence of the mobile device in the vehicle and to permit the start of the engine. Thanks to this system, the user does not need to insert the machine key into the keyhole for locking or unlocking, and the convenience is increased.

FIG. 3 is a block diagram of a conventional on-vehicle device. In FIG. 3, receiving antenna 20 receives a radio signal from mobile device 1, and on-vehicle device 29 transmits a converted electric signal to receiving circuit 21. Receiving circuit 21 feeds, into control unit 22, a received signal that has been returned to the state of the original transmitted signal supplied from mobile device 1 by amplifying or demodulating the electric signal. On receiving the received signal, control unit 22 compares the identification (ID) code of mobile device 1 included in the received signal with the code previously stored in control unit 22, thereby determining whether the received signal is correct or incorrect.

Control unit 22 drives driving circuit 23 using driving signal A, and supplies antenna current IA to vehicle antenna 27. Here, antenna current IA is supplied from power supply VD to driving circuit 23 through shunt resistor RS of detector 26, and flows to vehicle antenna 27 via driving circuit 23.

Detector 26 is formed by connecting differential amplifier 26A to both ends of shunt resistor RS, and differential amplifier 26A amplifies the voltage generated across shunt resistor RS by flowing of antenna current IA. Differential amplifier 26A feeds back detection signal B generated by amplification to control unit 22.

On receiving the radio signal from mobile device 1, on-vehicle device 29 collates the ID code of mobile device 1 included in the received signal with the code previously stored in on-vehicle device 29 using control unit 22. When the codes match, on-vehicle device 29 controls and makes a door actuator automatically open or close the door lock.

On-vehicle device 29 determines a failure of vehicle antenna 27. The reason for determining the failure is described hereinafter. There are a plurality of vehicle antennas 27, namely an internal antenna for the inside of the vehicle and an external antenna for the outside of the vehicle. In the description below, the external antenna disposed in a door knob is described as an example.

FIG. 4 is a schematic diagram of an essential component of the conventional on-vehicle device. In FIG. 4, each vehicle antenna 27 has antenna element 27A formed by interconnecting coil L and capacitor C in series, harness 27B formed by twisting two lead wires, and connector 27C connected to terminal T of on-vehicle device 29. On-vehicle device 29 is disposed at the back of the dashboard on the front side, and vehicle antenna 27 is disposed in a rear door knob on the rear side. The wiring distance between both of them, namely the entire length D of harness 27B, can exceed 6 m.

When vehicle antenna 27 is disposed in the door knob, harness 27B passes the hinge part of the door. Therefore, harness 27B can become caught between the door and the vehicle body by opening/closing of the door, or can be bitten during assembling the vehicle. A short circuit or opening failure can therefore occur disadvantageously.

This is the reason for determining the failure of vehicle antenna 27.

The operation of determining the failure of vehicle antenna 27 is described hereinafter.

First, control unit 22 feeds driving signal A into driving circuit 23, power supply VD is turned on based on driving signal A, and antenna current IA is supplied. Detector 26 converts antenna current IA into voltage with shunt resistor RS, and feeds back detection signal B to control unit 22. Here, detection signal B is generated by amplifying the voltage with differential amplifier 26A. As a result, control unit 22 determines the failure of vehicle antenna 27 based on detection signal B.

When vehicle antenna 27 is normal, the voltage of power supply VD becomes a remaining voltage after consumption by vehicle antenna 27, and the voltage of detection signal B becomes smaller than that of power supply VD. Control unit 22 determines that vehicle antenna 27 is normal.

When the voltage of detection signal B is 0 V, namely antenna current IA does not flow at all, control unit 22 determines "open failure" of vehicle antenna 27. When the voltage of detection signal B is equal to that of power supply VD, namely when entire antenna current IA is consumed in shunt resistor RS, control unit 22 determines "short circuit failure" of vehicle antenna 27.

Thus, conventional on-vehicle 29 determines the failure of vehicle antenna 27 using antenna current IA that flows in shunt resistor RS of detector 26, namely antenna current IA that is supplied to driving circuit 23. Here, shunt resistor RS is connected in series between power supply VD and driving circuit 23.

An example of the conventional art document information related to this technology is Japanese Patent Unexamined Publication No. S62-10704.

In conventional on-vehicle device 29, however, detector 26 is formed of shunt resistor RS and differential amplifier 26A, so that the circuitry becomes complex and expensive. When vehicle antenna 27 is normal, antenna current IA is consumed wastefully by shunt resistor RS.

SUMMARY OF THE INVENTION

The present invention provides an on-vehicle device that has simple and inexpensive circuitry and does not cause waste current consumption.

The on-vehicle device of the present invention has the following elements:

- a receiving antenna for receiving a radio signal from a mobile device;
- a receiving circuit for returning an electric signal obtained by conversion by the receiving antenna to the state of the original transmitted signal supplied from the mobile device;
- a control unit for determining the correct/incorrect of the received signal from the receiving circuit;

a driving circuit that is driven in response to a driving signal from the control unit and supplies antenna current to a vehicle antenna; and a detector for detecting whether the vehicle antenna operates normally.

The detector is formed of a capacitor, its one end is connected to the midpoint between the driving circuit and the vehicle antenna, and the other end is connected to the input side of the receiving circuit. When a detection signal for detecting a failure of the vehicle antenna is fed back to the control unit, the control unit determines the failure of the vehicle antenna based on the detection signal.

The detector extracts, by filter operation, voltage variation of the antenna current flowing between the driving circuit and the vehicle antenna. Then, the voltage variation of the antenna current is amplified by the receiving circuit. The control unit determines the failure of the vehicle antenna based on the amplified detection signal.

Thus, the detector has simple and inexpensive circuitry. The antenna current is not consumed wastefully.

As the capacitor of the detector, an electronic component may be used. When conductors of wiring boards are used and a gap is formed between two facing conductors, however, the capacitor becomes more inexpensive.

The control unit of the on-vehicle device of the present invention, on determining that the vehicle antenna is failed, stops the operation of the driving circuit. Stopping the operation of the driving circuit can prevent battery degradation especially when the engine is stopped.

On determining that the vehicle antenna is failed, the control unit of the on-vehicle device of the present invention announces the fact. The control unit can urge the user or the like to perform maintenance in response to this announcement.

DETAILED DESCRIPTION OF THE INVENTION

An exemplary embodiment of the present invention will be described with reference to FIG. 1 and FIG. 2. Elements similar to those in the description in Background Art are denoted with the same reference marks, and the detailed description is simplified.

Exemplary Embodiment

Figure 1:
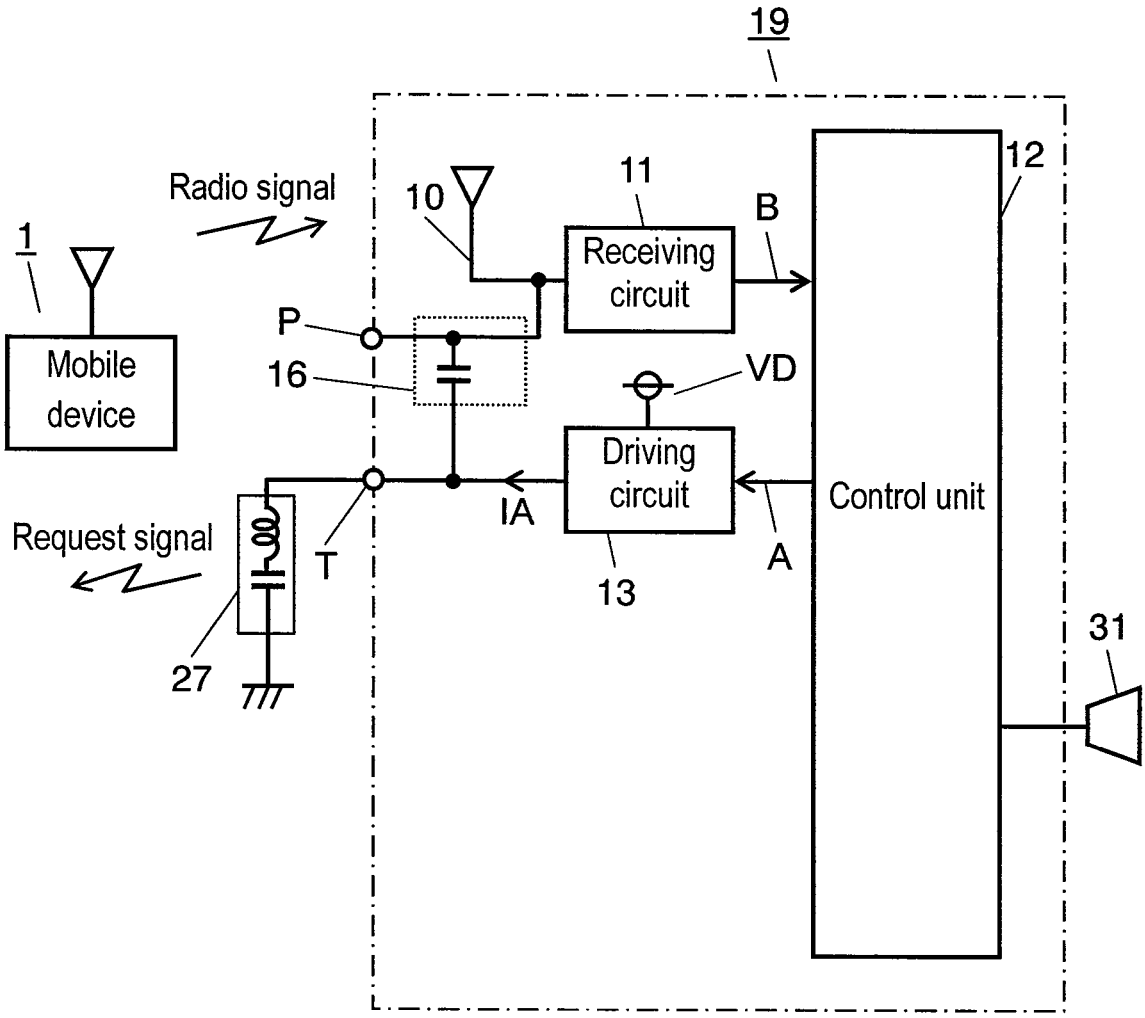
FIG. 1 is a block diagram of an on-vehicle device in accordance with an exemplary embodiment of the present invention.

FIG. 1 is a block diagram of an on-vehicle device in accordance with an exemplary embodiment of the present invention. In FIG. 1, receiving antenna 10 receives a radio signal of a radio frequency (RF) band from mobile device 1, and converts the radio signal into an electric signal. Receiving circuit 11 returns the electric signal obtained by conversion by receiving antenna 10 to the state of the original transmitted signal supplied from mobile device 1 by amplifying or demodulating the electric signal, and outputs a received signal. Control unit 12 determines whether the received signal from receiving circuit 11 is correct or incorrect.

In order to confirm the existence of mobile device 1, control unit 12 outputs driving signal A to drive driving circuit 13. When power is supplied from power supply VD to driving circuit 13 in response to driving signal A, driving circuit 13 supplies antenna current IA to vehicle antenna 27 connected to the outside. As a result, vehicle antenna 27 transmits a request signal of a low frequency (LF) band to a predetermined region.

One end of detector 16 is connected to the midpoint between driving circuit 13 and vehicle antenna 27, and the other end is connected to the input side of receiving circuit 11. Detector 16 generates a detection signal for detecting whether vehicle antenna 27 operates normally.

Detector 16 is formed only of a capacitor. The capacitor is an electronic component itself, or is formed by disposing a gap between two conductors of wiring boards and by etching them.

In this structure, on receiving the radio signal from mobile device 1, on-vehicle device 19 determines the correct/incorrect of the received signal with control unit 12. When the received signal is determined to be correct, on-vehicle device 19 collates the ID code of mobile device 1 included in the received signal with the code previously stored in on-vehicle device 19. When the ID code is the same as the previously stored code, the information code included in the received signal is decoded. When the information indicates unlocking, for example, control unit 12 controls a door actuator (not shown) and opens the door lock.

On-vehicle device 19 determines a failure of vehicle antenna 27.

Figure 2:
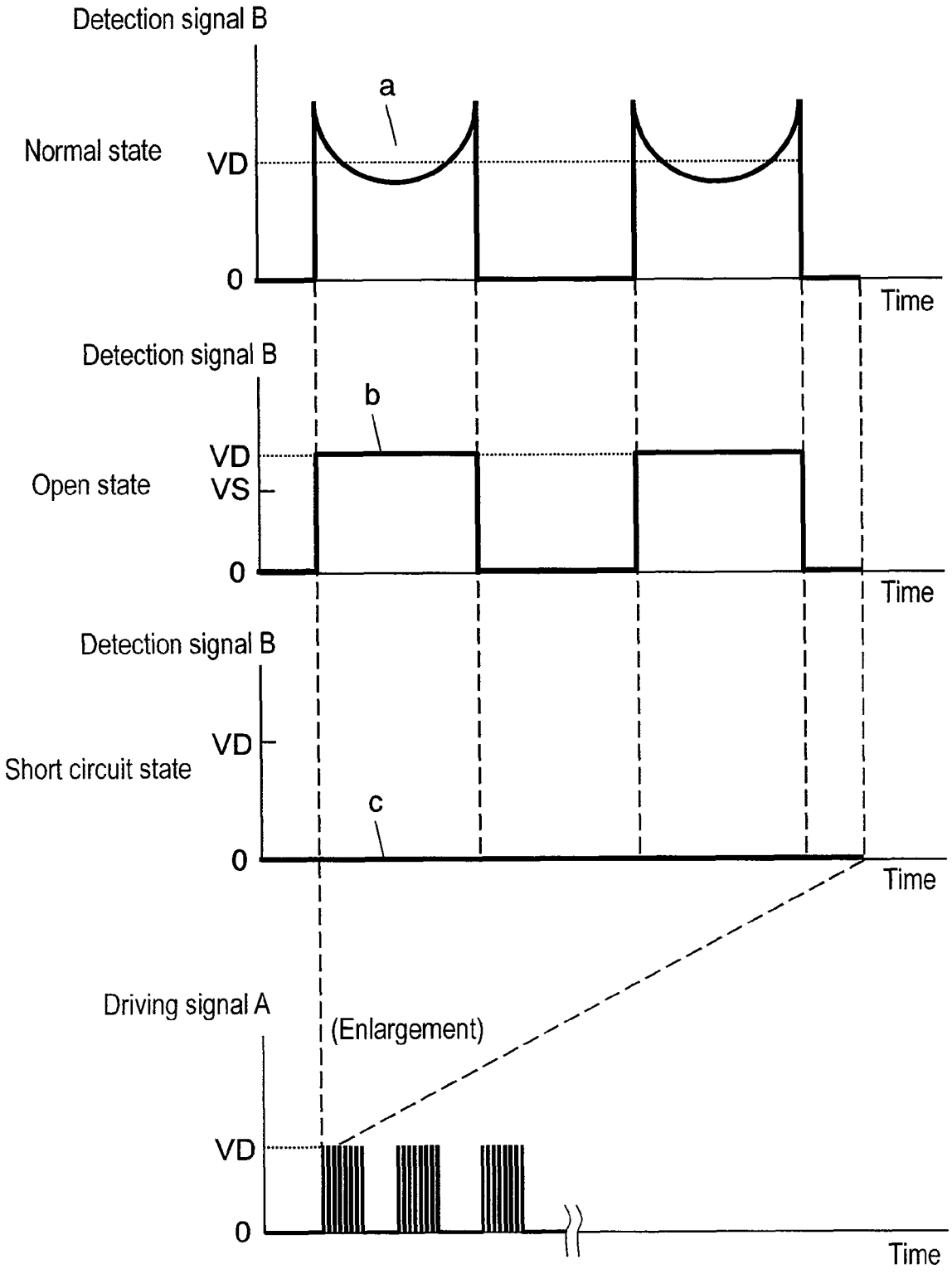
FIG. 2 is an explanation drawing of the on-vehicle device in accordance with the exemplary embodiment.
Figure 3:
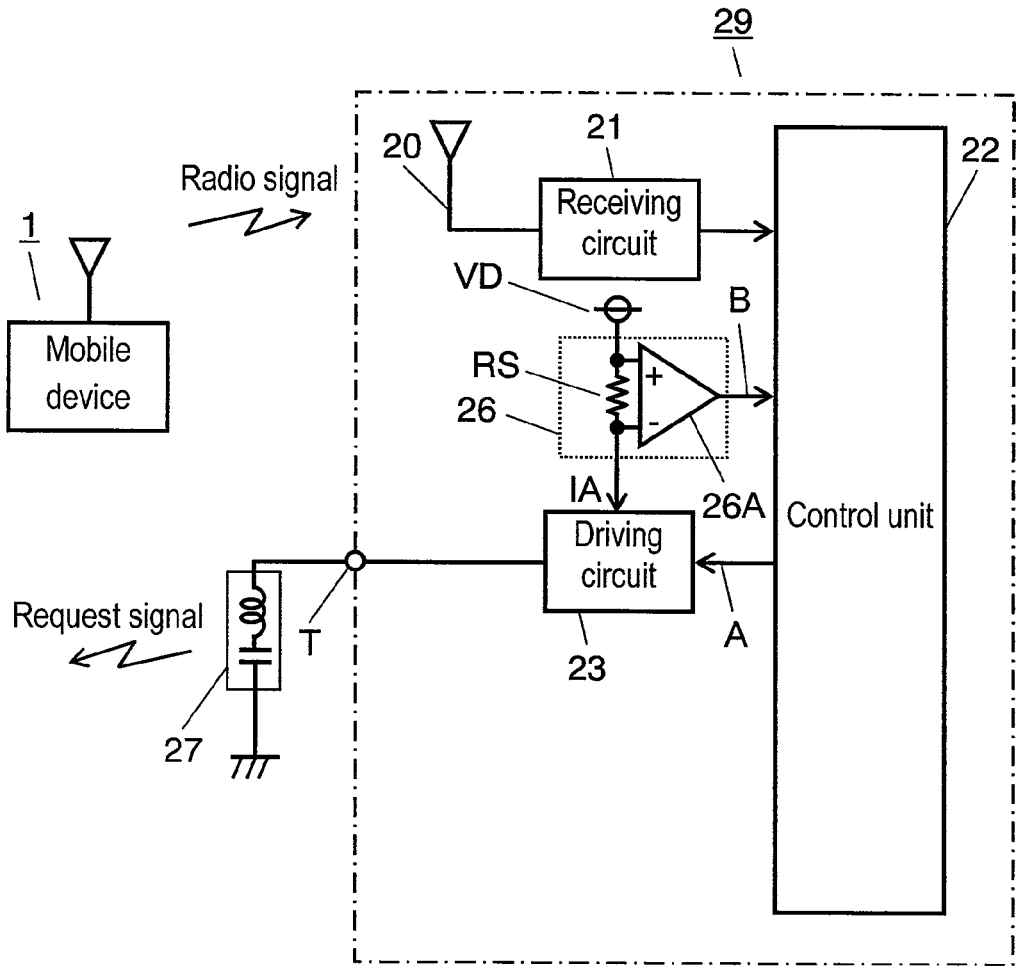
FIG. 3 PRIOR ART
FIG. 3 is a block diagram of a conventional on-vehicle device.

FIG. 2 is an explanation drawing of the on-vehicle device in accordance with the exemplary embodiment of the present invention. In FIG. 2, the request signal supplied from on-vehicle device 19 is formed of driving signal A from control unit 12. In other words, power is supplied from power supply VD to driving circuit 13 based on driving signal A, driving circuit 13 supplies antenna current IA to vehicle antenna 27. As a result, vehicle antenna 27 transmits the request signal converted from antenna current IA.

At this time, detector 16 generates a filter signal by filtering a voltage waveform with the capacitor, feeds the filter signal into receiving circuit 11, and feeds back detection signal B amplified by receiving circuit 11 to control unit 12. Here, the voltage waveform is generated at the midpoint between driving circuit 13 and vehicle antenna 27 by flowing of antenna current IA.

On-vehicle device 19 performs the failure determination of vehicle antenna 27 whenever it transmits the request signal, but does not perform the failure determination while it receives a radio signal from mobile device 1. Therefore, receiving circuit 11 can be used for amplifying the filter signal when a failure is determined.

Figure 4:
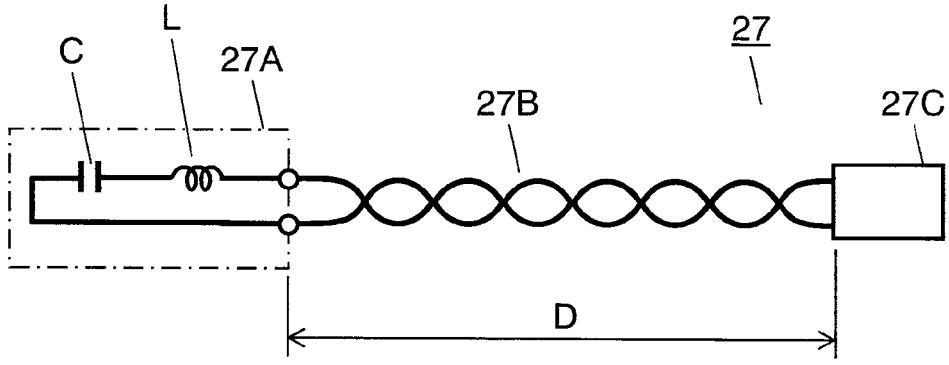
FIG. 4 PRIOR ART
FIG. 4 is a schematic diagram of an essential component of the conventional on-vehicle device.

The capacity value of the capacitor of detector 16 is set at a value that is extremely smaller than that of capacitor C of vehicle antenna 27 shown in FIG. 4 and does not affect the antenna characteristic of vehicle antenna 27.

The failure determination of vehicle antenna 27 is performed even in an engine stop state. That is because on-vehicle device 19 needs to communicate with mobile device 1 even in the engine stop state.

Control unit 12 determines that vehicle antenna 27 is normal when detection signal B has enlarged bowl-shaped waveform (a) shown in FIG. 2. In other words, detection signal B shown by waveform (a) sharply varies beyond the level of power supply VD due to the back electromotive voltage of coil L of vehicle antenna 27 at rising or falling times of driving signal A. The waveform between these times has a characteristic of a largely recessed shape. Therefore, this signal is determined to indicate that vehicle antenna 27 operates normally.

When detection signal B has enlarged rectangular waveform (b) shown in FIG. 2, vehicle antenna 27 is determined to undergo "open failure". The voltage level of detection signal B having waveform (b) is VD, namely the same as that of driving signal A. In other words, it is indicated that antenna current IA does not flow, so that "open failure" is determined.

When detection signal B has enlarged 0V-fixed waveform (c) shown in FIG. 2, vehicle antenna 27 is determined to undergo "short circuit failure" . Waveform (c) indicates that there is no detection signal B. In other words, vehicle antenna 27 as a load is in the short circuit state, and large antenna current IA (short circuit current) flows, so that "short circuit failure" is determined.

Thus, detector 16 feeds back, to control unit 12, detection signal B having each of waveforms (a)-(c) filtered by the capacitor. Control unit 12 performs the failure determination of vehicle antenna 27 based on the detection signal B.

When vehicle antenna 27 is determined to be failed, control unit 12 stops the output of driving signal A to stop the operation of driving circuit 13, drives announcing device 31 such as a speaker or lamp disposed in a vehicle shown in FIG. 1, and informs the user of the fact that vehicle antenna 27 is failed.

In the on-vehicle device of the present embodiment, detector 16 formed of a capacitor is connected between the midpoint between driving circuit 13 and vehicle antenna 27 and the input side of receiving circuit 11, thereby providing inexpensive on-vehicle device 19 having simplified circuitry.

As the capacitor of detector 16, an electronic component may be used. When a conductor of a wiring board is used, however, the capacitor can be more inexpensive.

When vehicle antenna 27 is failed, stopping the operation of driving circuit 13 can prevent battery degradation especially when vehicle antenna 27 undergoes the short circuit failure. The user or the like can be urged to perform the maintenance by announcement of the failure state.

In the present embodiment, the open state has been described using an example of a complete open state shown by enlarged waveform (b) of FIG. 2, namely detection signal B is at the level of power supply VD. However, the present invention is not limited to this, and a state between the semi-open state and the semi-short-circuit state can be detected. The state between the semi-open state and the semi-short-circuit state can be detected also when the voltage of enlarged waveform (b) becomes lower than that of power supply VD of the complete open state, namely leak current flows from vehicle antenna 27 to the vehicle body to make the voltage of enlarged waveform (b) lower than reference voltage VS.

Even when there are a plurality of vehicle antennas 27, the number of required detectors 16 is only one to all the vehicle antennas 27. In this case, respective vehicle antennas 27 are connected to driving circuit 13 in parallel via switches, and vehicle antennas 27 are connected to terminal T of detector 16. When one driving circuit 13 individually operates the vehicle antennas while the ON timings of respective switches are shifted from each other, it can be detected which vehicle antenna is failed.

The on-vehicle device of the present invention is useful as an on-vehicle device or the like used for a system that is inexpensive, does not cause waste current consumption, and remotely controls the locking/unlocking of a vehicle door or the like and the start of the engine.

What is claimed is:

1. An on-vehicle device comprising:

a receiving antenna for receiving a radio signal from a mobile device;

a receiving circuit for returning an electric signal obtained by conversion by the receiving antenna to a state of an original transmitted signal supplied from the mobile device;

a control unit for determining whether a received signal from the receiving circuit is correct or incorrect;

a driving circuit that is driven in response to a driving signal from the control unit and supplies antenna current to a vehicle antenna; and a detector for detecting whether the vehicle antenna operates normally, wherein the detector is formed of a capacitor, and wherein, when a detection signal of the detector for detecting a failure of the vehicle antenna is fed back to the control unit, the control unit determines a failure of the vehicle antenna based on the detection signal.

2. The on-vehicle device of claim 1, wherein one end of the capacitor is connected to a midpoint between the driving circuit and the vehicle antenna, and the other end of the capacitor is connected to the input side of the receiving circuit.

3. The on-vehicle device of claim 1, wherein the control unit stops operation of the driving circuit when the control unit determines that the vehicle antenna is failed.

4. The on-vehicle device of claim 1, wherein the control unit performs announcement when the control unit determines that the vehicle antenna is failed.

* * * * *